US005580630A

United States Patent [19]

Byrd

[11] Patent Number: 5,580,630

[45] Date of Patent: Dec. 3, 1996

[54] MULTI-LAYER WATERPROOFING ARTICLES INCLUDING A LAYER OF WATER-SOLUBLE POLYMER

[75] Inventor: Stacy W. Byrd, Chicago, Ill.

[73] Assignee: AMCOL International Corporation, Arlington Heights, Ill.

[21] Appl. No.: 477,765

[22] Filed: Jun. 7, 1995

Related U.S. Application Data

[62] Division of Ser. No. 386,154, Feb. 9, 1995, abandoned, which is a continuation of Ser. No. 8,738, Jan. 25, 1993, abandoned.

[51] Int. Cl.[6] ..... B32B 9/04; B32B 13/04

[52] U.S. Cl. ..... 428/47; 428/201; 428/332; 428/339; 428/143; 428/350; 428/351; 428/354; 428/356; 428/913; 428/150

[58] Field of Search ..... 428/291, 331, 428/454, 521, 448, 453, 913, 351, 343, 352, 354, 355, 47, 201, 332, 339, 350, 356, 143, 150

[56] References Cited

U.S. PATENT DOCUMENTS 4,440,830 4/1984 Wempe ..... 428/352
4,656,062 4/1987 Harriett ..... 427/397.8
4,775,567 10/1988 Harkness ..... 428/40

*Primary Examiner*—Kathleen Choi
*Attorney, Agent, or Firm*—Marshall, O'Toole, Gerstein, Murray & Borun

[57] ABSTRACT

A multi-layer article that includes a layer of a water-soluble polymer that provides a water-removable, non-tacky film over an adhesive layer and/or acts as an adhesive for securing the multi-layer article to a substrate, such as concrete, when wetted. The article forms a water barrier capable of being secured to an area of potential water flow including a layer of flexible, water-impermeable sheet material having a continuous or discontinuous coating of a water-soluble polymer thereon. When the water-soluble polymer is wetted to at least partially solubilize the water-soluble coating, the polymer readily adheres the article to a substrate at the area of potential water flow. In a preferred embodiment, the flexible sheet material includes a layer of adhesive (tacky material) and the adhesive layer is coated with the layer of water-soluble polymer to eliminate the necessity of using a sheet of release paper to prevent the adhesive layer from adhering to itself, when in roll form, and during handling and installation.

8 Claims, 2 Drawing Sheets

Fig. 1
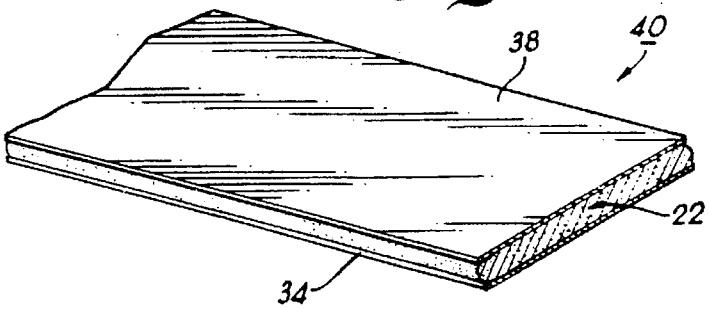
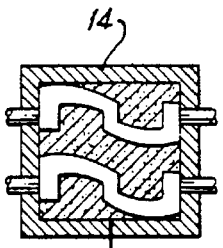
Fig. 2
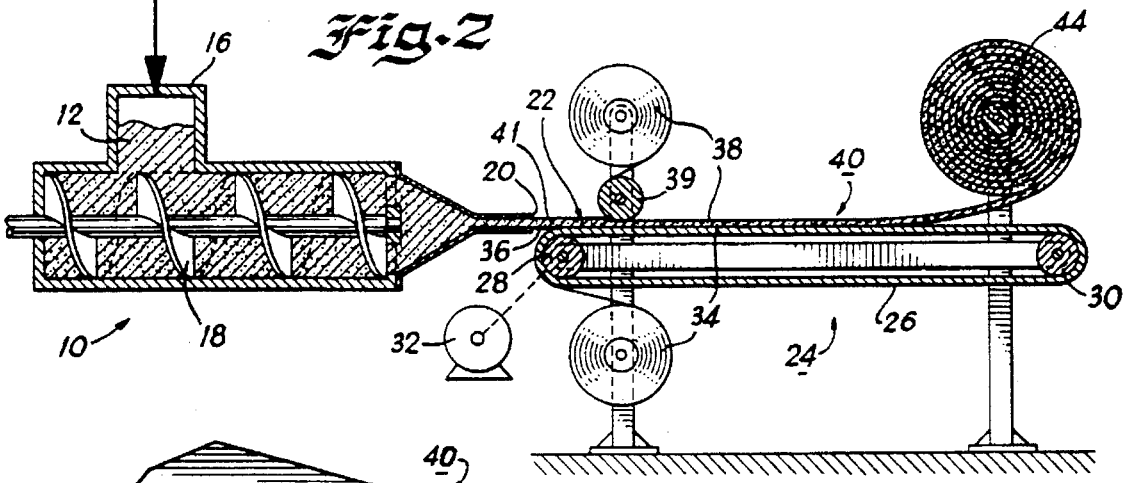
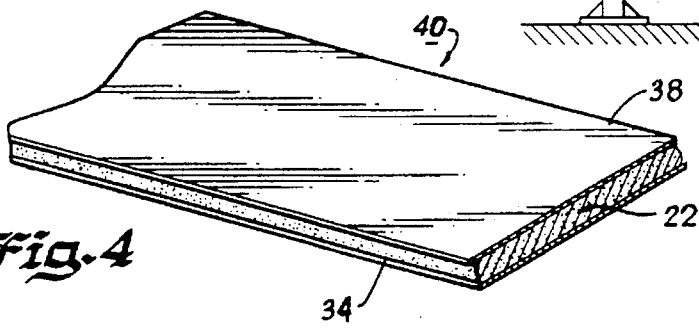
Fig. 4
Fig. 3
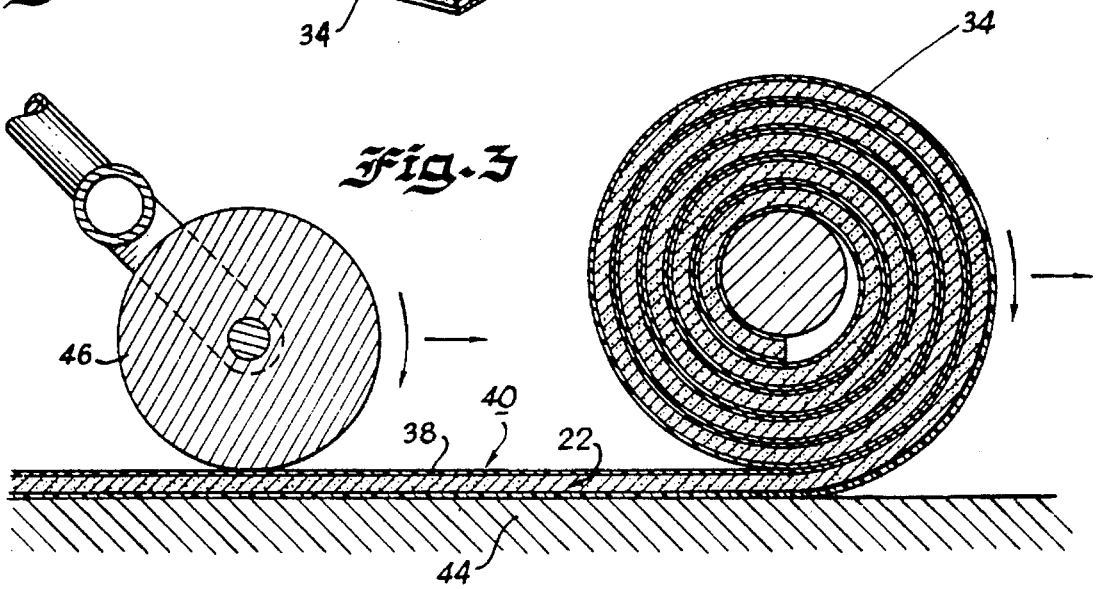

MULTI-LAYER WATERPROOFING ARTICLES INCLUDING A LAYER OF WATER-SOLUBLE POLYMER

This is a divisional of U.S. application Ser. No. 08/386,154, filed Feb. 9, 1995, now abandoned, which is a continuation of application Ser. No. 08/008,738, filed Jan. 25, 1993, now abandoned.

FIELD OF THE INVENTION

The present invention is directed to a multi-layer article that includes a layer of a water-soluble polymer that provides a water-removable, non-tacky film over an adhesive layer and/or acts as an adhesive for securing the multi-layer article to a substrate, such as concrete, when wetted. More particularly, the present invention is directed to a water barrier capable of being secured to an area of potential water flow including a layer of flexible, water-impermeable sheet material having a continuous or discontinuous coating of a water-soluble polymer thereon. When the water-soluble polymer is wetted to at least partially solubilize the water-soluble coating, the polymer readily adheres the article to a substrate at the area of potential water flow. In a preferred embodiment, the flexible sheet material includes a layer of adhesive (tacky material) and the adhesive layer is coated with the layer of water-soluble polymer to eliminate the necessity of using a sheet of release paper to prevent the adhesive layer from adhering to itself, when in roll form, and during handling and installation.

BACKGROUND OF THE INVENTION AND PRIOR ART

For more than 25 years waterproofing substrates, in the form of flexible sheet materials, have been manufactured for waterproofing areas of potential water flow, such as over concrete decks, plaza decks, concrete foundations, and the like. One such waterproofing sheet material manufactured by W. R. Grace & Co., is called BITUTHENE® formed from a water-impermeable membrane, such as polyethylene, polypropylene or polyvinyl chloride, and a layer of a bituminous composition containing asphalt, tar or pitch and natural or synthetic rubber, having a ratio by weight of bitumin to rubber greater than about 80:20, and up to about 95:5, as described in U.S. Pat. Nos. 3,900,102 and 3,741,856 of John Hurst. As disclosed in the Hurst patents, because of the adhesive nature of the bituminous adhesive layer, a protective coating is needed, such as siliconized release paper, that is removably adhered to the bituminous adhesive composition layer to prevent the adhesive layer from adhering to itself during manufacture, handling and installation, or upon manufacture of the waterproofing material in roll form. In order to install the waterproofing article at an area of potential water flow, it is necessary to remove the release paper, in very large and cumbersome sheets, from the adhesive layer for contact of the adhesive layer against the area of potential water flow, e.g., against a concrete surface.

Similar release papers are applied to this Assignee's waterproofing membrane structures, as disclosed in this Assignee's Harriett U.S. Pat. Nos. 4,656,062; 4,810,573; 4,733,989; 4,787,780; 4,668,724; and 4,534,926; all hereby incorporated by reference. A sheet of release paper is applied over the bentonite clay/elastomer or polypropene or polybutene compositions described in this Assignee's aforementioned patents to prevent the waterproofing materials from adhering to themselves during manufacture, handling and installation, or when the materials are manufactured in roll form.

In accordance with the present invention, it has been found that a coating of a water-soluble polymer, preferably polyvinyl alcohol, having a desired degree of water-solubility, eliminates the disadvantages of the necessity of applying a stripable release paper onto the adhesive side of the waterproofing article. Further, quite surprisingly, the water-soluble polymer acts like an anaerobic sealant to tenaciously bond the waterproofing article to the surface of the substrate upon at least partial hydration of the water-soluble polymer layer, with or without an adjacent layer of an adhesive material.

While water-soluble polymers have been used over water-permeable facing sheets for preventing premature hydration of a water-swellable clay layer thereunder, as disclosed in this Assignee's Alexander U.S. Pat. Nos. 5,053,265; 5,063,100 and 5,180,255, the water-soluble polymers have not been recognized as adhesive materials, and have not been used to coat an underlying adhesive layer.

SUMMARY OF THE INVENTION

In brief, the present invention is directed to a multi-layer waterproofing article, and method of waterproofing using the article, whereby a water-soluble polymer film or coating forms an outer major surface of the article for avoiding any need for release paper, and/or for adhesively securing the article to a substrate to be waterproofed.

Accordingly, one aspect of the present invention is to provide a new and improved multi-layer waterproofing article, and method, that includes an outer layer of a water-soluble polymer instead of release paper.

Another aspect of the present invention is to provide a new and improved multi-layer waterproofing article, and method, that includes an outer layer of a water-soluble polymer, preferably polyvinyl alcohol, that becomes adhesive upon at least partial solubilization and drying in place.

Still another aspect of the present invention is to provide a new and improved multi-layer waterproofing article, and method, that is non-tacky when dry, and can be made tacky over an entire major surface, or discontinuously over an entire major surface, by wetting to partially solubilize an outer layer of a water-soluble polymer.

These and other aspects, features, and advantages of the present invention will be apparent to those of ordinary skill in the art in view of the detailed description of the preferred embodiments, which is made with reference to the drawings, a brief description of which is provided below.

BRIEF DESCRIPTION OF THE DRAWINGS

FIG. 1 is a partially broken-away perspective view of an article of manufacture of the present invention including a water-impermeable top sheet, a lower layer of a water-soluble film and an intermediate adhesive composition layer, such as a water-swellable composition containing bentonite clay;

FIG. 2 is a schematic view of the apparatus used to manufacture the article of manufacture of FIG. 1;

FIG. 3 is a side view showing a roll of the sheet material of FIG. 1 being applied to a substrate, such as a building material surface, with the film of water-soluble polymer applied against a wetted concrete surface;

FIG. 4 is a partially broken-away perspective view of another article of manufacture of the present invention, similar to the article of FIG. 1, and having a film of water-soluble polymer applied on longitudinal edges as well as on one major surface of the article.

DETAILED DESCRIPTION OF THE PREFERRED EMBODIMENTS

Figure 5:
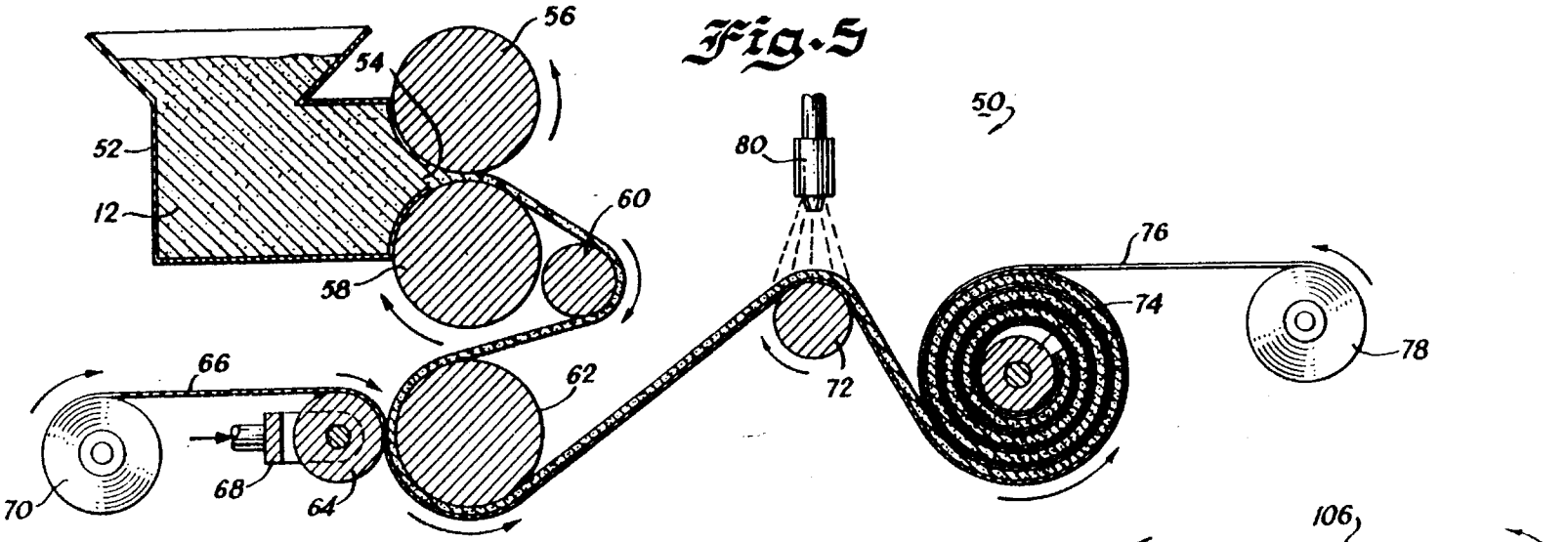
FIGS. 5 and 6 are schematic views of alternate apparatus used to manufacture the article of manufacture of FIG. 1, or similar articles of manufacture.

In accordance with the preferred embodiment of the present invention, a waterproofing article 40 includes a water-impermeable flexible sheet material 38, e.g., polyethylene, and a layer of an adhesive material 22, preferably a water-swellable clay intimately mixed with a polypropene, a polybutene or a mixture of polypropene and polybutene, to provide a tacky composition having an excellent adhesive quality and capacity for swelling. Preferably, a water-swellable clay, for example sodium bentonite, is included in the adhesive composition layer in an amount of about 35% to about 90% by weight, and polypropene and/or polybutene is included in the clay composition layer in an amount of about 10% to about 65% by weight of the composition. It should be understood that any essentially water-impermeable or adhesive composition 22 can be secured to the water-impermeable sheet material layer 38, such as the bitumen-rubber composition disclosed in U.S. Pat. No. 3,900,102, hereby incorporated by reference.

To achieve the full advantage of the preferred embodiment of the present invention, the adhesive composition layer 22 should include polypropene, polybutene or mixtures thereof in an amount of at least about 15% by weight. Additional tackifiers compatible with the polypropenes or polybutenes may be included for additional tack so long as the polypropene, polybutene or mixture is included in at least about 10% by weight of the composition. Additional compatible tackifiers may include, for example, aliphatic petroleum hydrocarbon resins, such as polyisobutylene, polyterpenes, hydrogenated resins, and mixed olefins. Generally, aromatic tackifiers are not suitable since they will bleed to the surface of the composition and separate, thereby reducing the handleability and consistency of the composition. Other additives, such as viscosity controlling agents, fillers, tackifiers and the like may be added in a total amount up to about 20% by weight of the adhesive composition to impart any desired physical characteristics to the clay composition layer.

The water-swellable colloidal clay utilized in the preferred clay composition embodiment of the multi-layered articles of the present invention is any water-swellable colloidal clay which will hydrate in the presence of water, i.e., will swell in the presence of water. Preferably, the colloidal clay is bentonite. A preferred bentonite is sodium bentonite which is basically a hydratable montmorillonite clay of the type generally found in the Black Hills region of South Dakota and Wyoming. This clay has sodium as a predominant exchange cation. However, the bentonite utilized in accordance with this embodiment of the present invention may also contain other cations such as magnesium and iron. There are cases wherein a montmorillonite predominant in calcium ions can be converted to a high swelling sodium variety through a well known process called "peptizing". The colloidal clay utilized in this invention may be one or more peptized bentonites. The colloidal clay may also be any member of the dioctahedral or trioctahedral smectite group or mixtures thereof. Examples are Beidellite, Nontronite, Hectorite and Saponite. The colloidal clay, i.e., bentonite, generally is finely divided as known for use in water barrier panels and the like, i.e., 150 to 350 mesh.

The polybutenes forming part of the preferred. water-swellable clay composition layer embodiment of the present invention, generally comprise $(C_4H_8)_n$, where n ranges from about 6 to about 45, having average molecular weights in the range of about 300 to about 2,500. The commercially available useful polybutenes are predominantly of high molecular weight mono-olefins and can include 100% of the polybutene or include up to about 10% isoparaffins. The polybutenes are chemically stable, permanently fluid liquids and their tackiness increases with increased molecular weight. The viscosities of the polybutenes range from a consistency of a light oil to a highly viscous fluid having a viscosity range of about 25 to about 4,000 centipoises. The lower viscosity polybutenes can be combined with a water-swellable clay to provide a composition having a soupy consistency which is very tacky and difficult to handle depending upon the quantity of water-swellable clay included within the clay composition layer of the multi-layer articles of the present invention.

The polypropenes forming part of the preferred water-swellable clay composition layer generally comprise $(C_3H_6)_n$, where n ranges from about 7 to about 60 having molecular weights in the range of about 300 to about 2,500. The commercially available polypropenes useful in the preferred clay composition layer generally are amorphous in character and may be combined with up to about 10% by weight of a suitable processing solvent, such as ligroin, although the polypropenes may be blended with the bentonite easily at elevated temperatures, i.e., 200° C. without a solvent.

To achieve the greatest swelling of the preferred compositions of the present invention, the polypropene or polybutene or mixtures should be present in the composition in an amount of about 15% to about 30% by weight of the total composition.

In testing to determine if the polypropenes and polybutenes would inhibit the swelling characteristics of the water-swellable clay layer, two compositions were prepared—the first containing approximately 78% bentonite and 22% polybutene and the second containing about 78% bentonite and 22% polypropene. For comparison, one gram of bentonite alone was placed in one graduated cylinder while one gram of the above two compositions were placed in a second and third graduated cylinder. Each of the compositions were wetted and permitted to swell for about 48 hours. After complete swelling, it was found that the bentonite alone swelled to a volume of about 9 ml while the two compositions containing polypropene or polybutene swelled to a volume of 10 ml.

The addition of an elastomer in an amount of about 1% to about 20% based on the total weight of the preferred water-swellable clay composition layer embodiment of the present invention will substantially increase the handleability of the composition without impeding its swellability. To achieve the full advantage of this embodiment of the present invention, the elastomer should be included in an amount of about 2% to about 10% based on the total weight of the clay composition layer. Surprisingly, it has been found that mastication or shearing, i.e., in a sigma blender, of a water-swellable clay composition containing a water-swellable clay, such as bentonite, polypropene and/or polybutene, and an elastomer, actually increases the capacity of the composition to swell in an amount greater than the water-swellable clay alone; and greater than the water-swellable clay, polypropene/polybutene composition without the elastomer.

In testing the swellability of the water-swellable clay composition layers including an elastomer, the two clay compositions prepared above (polybutene and polypropene) were blended separately in a sigma blender with 4.95% partially cross-linked butyl rubber to thoroughly masticate the butyl rubber into the compositions to form two homogeneous blends. One gram of each of the compositions containing 4.95% butyl rubber, 75.25% bentonite clay and 19.8% of polybutene or polypropene were placed in two graduated cylinders and submerged in water for approximately 48 hours to make sure that the compositions were completely swelled. When completely swelled, one gram of each composition containing the butyl rubber had swollen to approximately 13 ml to 14 ml—greater than the swelling which occurred with one gram of bentonite alone and greater than the swelling which occurred with the bentonite/polypropene or bentonite/polybutene compositions, although these compositions without elastomer actually included more bentonite. The compositions containing the butyl rubber were easily handleable and extrudable to any desired shape and would retain their form when adhered to a surface for water seepage control.

Essentially any elastomer, preferably having at least 100% elongation and, more preferably having at least 500% elongation, can be used in the preferred water-swellable clay composition layer of the present invention to substantially improve the handleability, cohesiveness and structural integrity of the water-swellable clay composition layer and multi-layered articles manufactured. Partially cross-linked elastomers have been found to be most suitable in improving the consistency, handleability and structural integrity of articles requiring such properties, but elastomers which are not cross-linked are also useful, particularly those polymers which are capable of being lightly cross-linked when subjected to the heat generated within the blender, i.e., sigma blender, during mastication and mixing with the other clay composition layer components. Fully, cross-linked elastomers generally are not suitable for incorporation into the clay composition layers of the present invention since their elongation capacity is insufficient to permit full expansion of the water-swellable clay during hydration. However, any elastomer having at least 100% elongation is suitable as a component of the water-swellable clay composition layer of the multi-layered or laminated articles described herein, and included within the scope of the present invention.

Additional suitable elastomers for incorporation into the preferred clay composition layer include polyisobutylene, styrene-butadiene, synthetic and natural rubbers, ethylene-propylene copolymers and terpolymers, halogenated butyl rubber, and partially cross-linked butyl rubbers having divinylbenzene added to form a terpolymer for the purpose of imparting a degree of "cure". The elastomer can be shredded prior to mastication with the water-swellable clay and polypropenes and/or polybutenes to decrease mixing time, although shredding is not necessary. Mastication and homogeneous flow of the elastomer throughout the water-swellable clay composition layer can be achieved with the elastomer in any desired shape, i.e., pellet form, for example in a sigma blender.

The water-swellable composition layer embodiment disclosed herein can include additives capable of forming a skin on the composition, such as a copolymer of vinyl toluene with a vegetable drying oil. The compositions containing skins are useful in accordance with the present invention since the water-soluble polymer layer develops tackiness, upon wetting, for securing the article in place in its intended location. If the water-soluble polymer film is secured as a solid film, an adhesive can be used to secure the film to the skin of the bentonite composition.

A water-swellable clay composition layer 22 can be provided including a water-swellable clay, such as bentonite, in an amount of 35–90% by weight, an elastomer in an amount of 1–20% by weight, and any plasticizer compatible with the elastomer and capable of plasticizing the elastomer, in an amount of 2–50% by weight based on the total weight of the clay composition layer. The plasticizer improves the workability of the elastomer, extends the elastomer, enables the elastomer to reposition itself with expansion of the water-swellable clay, when the clay is wetted, and wets the water-swellable clay surface sufficiently to enable the elastomer to accept substantial amounts of the water-swellable clay (up to about 90%) and to provide a homogeneous clay distribution throughout the elastomer in the clay composition layer.

It has been found that an elastomer having an elongation of at least 100% will permit the water-swellable clay to substantially completely expand upon water contact so long ass the elastomer includes a plasticizer in an amount of at least 2% based on the total weight of the clay composition layer. The elastomer provides exceptionally good structural integrity to the clay composition layer without substantially inhibiting the swellability of the clay. The elastomers should be partially, but not completely, cross-linked and include, for example, butyl rubber, styrene-butadiene, other synthetic and natural rubbers, ethylene-propylene copolymers, ethylene and propylene terpolymers.

Suitable plasticizers are the relatively low polarity plasticizers including epoxidized oils, such as epoxidized soybean oil; alkyl monoesters such as butyl oleate; long chain partial ether esters, such as butyl cellosolve oleate; long chain alkyl diesters, such as dioctyl adipate and dioctylphthalate; and petroleum-derived plasticizers such as aromatic-naphthenic oils; napthenic-aromatic oils, napthenic-paraffinic oils; and paraffinic oil.

To achieve the full advantage of this clay/plasticizer embodiment for the adhesive layer, the plasticizer should be included in the clay composition layer in an amount of at least about 10% by weight of the composition to plasticize the elastomer and fully wet-out the bentonite. The plasticizers generally are included in an amount of about 10% to about 30% by total weight of the clay composition layer.

Other suitable adhesive compositions that aid in waterproofing include a layer of asphalt, tar or pitch and mixtures of one or more of these bituminous compositions together with natural or synthetic rubber.

Many water-soluble polymers are available, as described in WATER-SOLUBLE SYNTHETIC POLYMERS: PROPERTIES AND BEHAVIOR, Molyneux, Vols. I and II, CRC Press, © 1983, hereby incorporated by reference. The preferred water-soluble polymer forming a layer or film coating 34 is poly(vinyl alcohol):

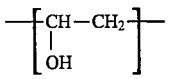

Since poly(vinyl alcohol) is manufactured from the hydrolysis of poly(vinyl acetate):

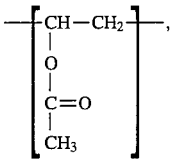

commercial polyvinyl alcohols always have a portion of unhydrolyzed poly(vinyl acetate) in the polymer. Above about 25 mol percent vinyl acetate, the polyvinyl alcohol becomes more difficultly solubilized, requiring hot water or more water contact time for complete solubility. Suitable commercial sources for water-soluble poly(vinyl alcohol) at various degrees of hydrolysis include: MONO-SOL water-soluble polyvinyl alcohol film of Chris Craft Industrial Products, Inc., Gary, Ind., e.g., cold water-soluble film M-7030; and ARMOR H-20 water-soluble films from Union Camp Corporation, Bag Division, Old Greenwich, Conn. Other suitable water-soluble polymers include the copolymers of vinyl alcohol and vinyl acetate, e.g., poly(vinyl acetate-co-vinyl alcohol):

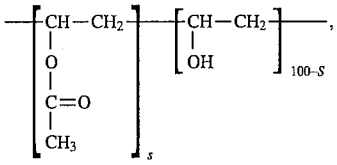

Also known as partially hydrolyzed poly(vinylacetate) or partially acetylated poly(vinyl alcohol), available commercially from DuPont as ELVANOL and from Airco Chemical as VINOL.

Other suitable water-soluble polymers include polyvinylpyrrolidone (PVP) having a monomeric structure as follows:

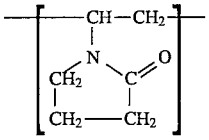

The water-solubility of PVP can be adjusted according to (1) the degree of hydrolysis of the polyvinylpyrrolidone to take into account different thicknesses of PVP films; and (2) by forming a metal salt of PVP, such as sodium or potassium. It is preferred that at least 50% of the PVP monomeric units are hydrolyzed to the structure:

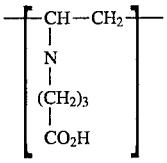

and that the PVP be used in the salt form, e.g., sodium or potassium polyvinylpyrrolidone. Such PVP coatings provide immediate partial solubility of the polymer film when wetted. The molecular weight of the polyvinyl alcohol or PVP polymers is not critical so long as the polymer is water-soluble. Excellent results can be obtained with PVP having weight average molecular weights in the range of about 225 to about 1,000,000 or more, preferably about 2,000 to about 100,000.

Other PVP derivatives that are water-soluble include the following: N-Methylpyrrolidone (NMP); N-Ethylpyrrolidone (NEP); and N-Vinylpyrrolidone (NVP), having the structures:

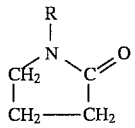

NMP: R=$CH_3$

NEP: R=$CH_3CH_2$

NVP: R=$CH_2CH$

Other substituted water-soluble pyrrolidones useful in accordance with the present invention include: N-isopropyl-5-methylpyrrolidone; pyrrolidone-N-acetic acid; N-cyclohexyl-pyrrolidone; and hexamethylene-bis(2-pyrrolidone). It appears that best results for polyvinylpyrrolidone and its derivatives are achieved when the PVP has about 80% to about 90% of its monomer units hydrolyzed.

Other water-soluble polymers useful in the multi-layer articles of the present invention include poly(ethylene oxide) having monomer units: —O—($CH_2$)—($CH_2$)—, hereinafter PEO; available as PLURACOL E from Wyandote, and POLYOX WSR or CARBOWAX from Union Carbide water-soluble even at the very S high molecular weights, e.g., 1,000,000 or more; poly(propylene oxide), having monomer units:

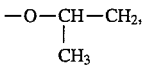

water-soluble only in the oligomer form, having weight average molecular weights from about 100 to about 1,000, preferably about 100 to about 500; poly(vinyl methyl ether), having monomer units:

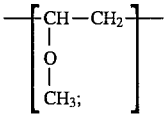

and their hydrolysis product derivatives. Poly(vinyl methyl ether) is water-soluble and available commercially as GANTREZ M from GAF Corporation and is water-soluble, like PEO, at room temperature, at very high molecular weights, e.g., weight average molecular weights from about 120 to about 1,000,000 and more. Another suitable water-soluble polymer is polyoxymethylene (POM) , having monomer units —O—$CH_2$—, which are water-soluble in the very short oligomer form, i.e., poly(formaldehyde) and having a melting point of about 180° C., and weight average molecular weights from about 40 to about 400. Oxide copolymers also are suitable as the water-soluble coating material, including random and block copolymers of poly(ethylene oxide) with a variety of monomers, including propylene oxide and/or poly(propylene oxide). One particularly useful copolymer is sold as PLURONIC F68 having a poly(propylene oxide) core molecular weight of about 1,800 and including 80% w/w ethylene oxide units, giving a combined molecular weight for the two outer poly(ethylene oxide) sections of 6,600—for a combined weight average molecular weight of 8,400.

The non cross-linked and lightly cross-linked polyacrylic acid polymers are also suitable, having monomer units:

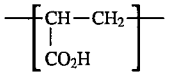

and are commercially available as CARBOPOL resins from B. F. Goodrich and PRIMAL resins from Rohm & Haas. Light cross-linking will slightly hinder the water-solubility for better adherence of the polymer to a substrate to be waterproofed.

Other, water-soluble derivatives of polyacrylic acid, and substituted polyacrylic acid also are useful in accordance with the present invention, such as poly(methacrylic acid), (PMAA), having a monomeric structure:

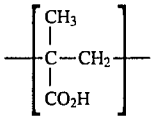

Similar water-soluble polymers that are suitable in accordance with the present invention include poly(methacrylamide), or PMAAm, having the general monomeric structure:

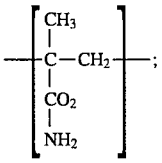

Poly(N,N-Dimethylacrylamide), having the general monomeric structure:

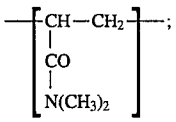

Poly(N-Isopropylacrylamide), or PIPAAm, having the monomeric structure:

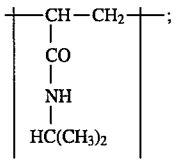

Poly(N-acetamidoacrylamide), having a monomeric structure:

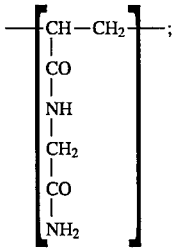

and Poly(N-acetamidomethacrylamide), having a monomeric structure:

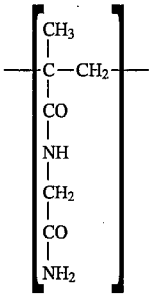

Water-soluble copolymers including any one or more of the above-described acrylic polymers also are useful in accordance with the principles of the present inventions, including the acrylic interpolymers of polyacrylic acid and poly(methacrylic acid); polyacrylic acid with poly(methacrylamide); and polyacrylic acid with methacrylic acid.

Other suitable water-soluble polymers include polyvinyloxazolidone (PVO) and polyvinylmethyloxazolidone (PVMO), having the monomeric structures:

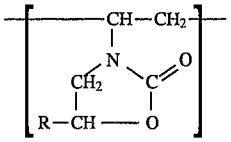

PVO: R = H
PVMO: R = $CH_3$

Turning now to the drawings, and initially to FIG. 2, apparatus, generally designated 10, is illustrated in schematic form for extruding the preferred bituminous or clay composition layer 22 of the multi-layer articles of the present invention into sheet form. In the preferred embodiment, the water-swellable clay composition 12 comprising an intimate mixture of bentonite, with polypropene and/or polybutene in one embodiment, or with a plasticizer in another embodiment; or other adhesive composition, such as the bituminous rubber composition of Hurst U.S. Pat. No. 3,900,102, is thoroughly blended in a homogeneous blend with an elastomer, such as butyl rubber, in a sigma blender 14 to fully masticate the elastomer to provide a homogeneous adhesive composition into an extruder 16. Auger 18 of extruder 16 forces the bentonite composition through a die opening 20 in extruder 16 to form a sheet, generally designated 22, of water-swellable clay composition. The sheet of material 22 is directed onto a conveyor, generally designated 24, including an endless conveyor belt 26 driven around rollers 28 and 30 by a conveyor motor 32. The conveyor 24 can be driven at a variety of predetermined speeds by the conveyor motor 32. By varying the speed of the conveyor belt 26 relative to the speed at which the extruded sheet 22 exits the die opening 20, the sheet can be stretched or compressed slightly to vary the thickness of the extruded clay composition sheet 22. The conveyor 24 includes a continuous supply of a water-soluble film 34 directed over the conveyor belt 26 for contact against an undersurface 36 of the sheet 22 being extruded through the die opening 20 of extruder 16.

A continuous supply of a water-impermeable sheet material 38 is disposed above the conveyor 24 to direct the sheet material 38 around contact roller 40 to adhere the sheet material 38 to an upper surface 41 of the bentonite composition sheet 22. The resulting laminated article of manufacture, generally designated 40 (FIG. 1), is wound around a take-up roller 44 as the bentonite composition sheet 22 is extruded onto the film of water-soluble polymer 34 to provide the laminate 40 in a coiled, roll form. Similarly, the sheet 40 may be cut to length at a suitable cutting station (not shown).

In accordance with a preferred embodiment of the present invention, the upper sheet material layer 38 and the adhesive layer 22 of the laminated article of manufacture 40 of the present invention should be water-impermeable to provide two waterproofing seals. The upper sheet material layer 38, under ideal conditions and proper installation will, by itself, prevent water or other liquids from penetrating the laminate 40. Frequently, however, it has been found that imperfect installation, particularly at seams, permits water or other liquid to penetrate a water-impermeable layer intended for waterproofing. Additionally, sometimes cracks or fissures develop in a "water-impermeable" sheet material permitting water penetration.

The bentonite compositions of the preferred embodiment will expand to an unexpected volume upon water contact while maintaining structural integrity to permanently fill any cracks, fissures or gaps left from improper installation, thereby acting as an unexpectedly effective safety valve to insure that the laminate 40 self heals to prevent essentially all liquid penetration to the substrate, e.g., building material or concrete 44 thereunder.

The multi-layer articles 40 of the present invention are particularly effective when applied to building materials, such as wood, concrete, rock and the like, since the articles readily adhere to solid, stable structures at the water-soluble film layer 34. If the water-soluble polymer completely washes away, the bentonite layer 22 is sufficiently tacky to provide tenacious adherence to the underlying structure 44.

The water-impermeable upper sheet of material 38 can be any flexible, water-impermeable sheet material, such as polyvinyl chloride, a polyolefin, such as polyethylene or polypropylene, and the like. Generally, the thickness of the water-impermeable sheet material 38 is on the order of about 3 mils to about 50 mils. The thickness of the film or coating of water-soluble polymer 34 is about 0.1 mil to about 15 mils, preferably about 1 mil to about 3 mils.

The apparatus of FIG. 5, generally designated 50 is illustrated schematically for forming the multi-layer articles including a flexible sheet or web 66, an adhesive layer extruded from composition 12, and a coating of water-soluble polymer 76. In the preferred embodiment, the thoroughly blended clay composition 12 is received in a hopper 52 having a discharge opening 54 disposed in horizontal alignment with a pair of forming rollers 56 and 58 having a predetermined spacing to provide a clay composition layer of a desired thickness. The forming rollers 56 and 58 are motor (not shown) driven clockwise to push the clay composition through the spacing between them and shape the clay composition into sheet form. It has been found that a suitable lubricant, such as a polyglycol, e.g., polyethylene glycol, in an amount of about 0.5% to 2.0% by weight, added to the clay composition, aids in preventing the clay composition from sticking to the forming rollers 56 and 58 and other apparatus during manufacturing.

The clay composition, in sheet form, is conveyed over a directional roller 60 and then between pressure rollers 62 and 64 where a sheet or web of water-impermeable flexible sheet material 66 is adhered to the clay composition 12 or any bituminous material, or any adhesive layer. The flexible sheet material 66 can be the same as the sheet material layer 38 described with references to FIGS. 1–4. The pressure applied on the sheet or web of water-impermeable flexible sheet material 66 can be adjusted to make sure the sheet material 66 adheres to the clay composition by adjusting yoke 68 to move the pressure roller 64 closer to or farther from pressure roller 62. The sheet material 66 is supplied between the pressure rollers 62 and 64 from a supply roll 70 of water-impermeable flexible sheet material.

The clay composition sheet material having a sheet or web of water-impermeable sheet material 55 applied thereto proceeds over directional roller 72 and is wound onto a take-up roller 74. During winding on take-up roller 74, a layer or film 76 of a water-soluble polymer, preferably poly(vinyl alcohol) is applied over the clay composition sheet material. If desired, the water-soluble polymer can be applied to the clay composition sheet material in liquid form, such as from spray nozzle 80, followed by a drying step (not shown) prior to rolling, as an alternative to applying a solid film of water-Soluble polymer 76 from roll 78. Further, the clay or bituminous layer 22 can be completely omitted prior to applying the water-soluble polymer in liquid form from spray nozzle 80; or an adhesive or light coating of water can be applied from nozzle 80 to adhere the solid film of water-soluble polymer 76, in sheet form, to water-impermeable sheet material 66, from roll 78.

Figure 6:
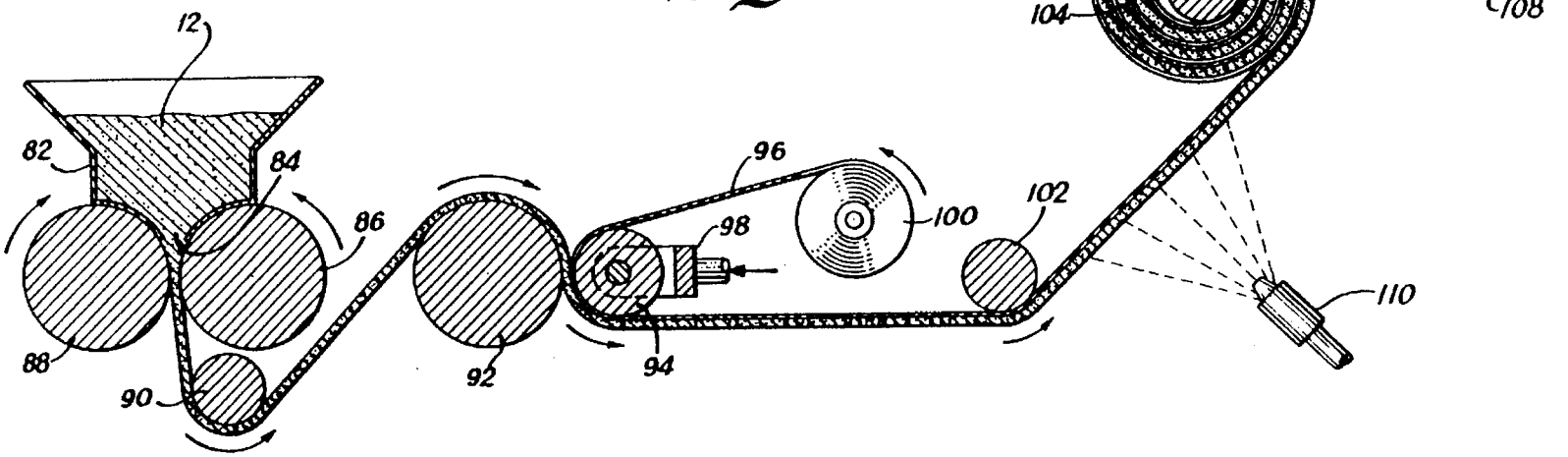

The manufacture of the multi-layer article of manufacture shown schematically in FIG. 6 is very much the same as that shown in FIG. 5 except that the clay composition or other adhesive material 12 is initially received in a hopper 82 having a discharge opening 84 disposed vertically above a pair of forming rollers 86 and 88 having a predetermined spacing to provide an adhesive composition layer of a desired thickness. The vertical disposition of the composition hopper 82 aids, by gravity, in forcing the adhesive composition 12 between motor (not shown) driven forming rollers 86 and 88.

The formed adhesive, e.g., bentonite clay composition in sheet form, is conveyed under a directional roller 90 and then between pressure rollers 92 and 94 where a sheet or web of water-impermeable, flexible sheet material 96 is adhered to the clay composition sheet material. The sheet material 96 can be the same as the sheet material layer 38 described with reference to FIGS. 1–4.

The pressure applied on the sheet or web of water-impermeable flexible sheet material 96 can be adjusted to make sure the sheet material 96 adheres to the layer of adhesive composition 12 by adjusting yoke 98 to move the pressure roller 94 closer to or farther from pressure roller 92. The sheet material 96 is supplied between the pressure rollers 92 and 94 from a supply roll 100 of water-impermeable, flexible sheet material 100.

The clay composition sheet material having a sheet or web of water-impermeable sheet material 96 applied thereto proceeds under directional roller 102 and is wound onto a take-up roller 104. During winding of take-up roller 104, the film or layer of water-soluble polymer 106 is applied over the adhesive layer to sandwich the adhesive composition sheet material between the water-soluble polymer layer 106 and the flexible, water-impermeable sheet material 96. The water-soluble polymer layer 106 acts as an adhesive when wetted and partially solubilized so that the adhesive layer 22 is unnecessary except as a safety barrier to prevent penetration of water. If desired, an adhesive or a light coating of water can be applied to the adhesive composition sheet material or to the water-impermeable sheet material 96, such as from spray nozzle 110, to secure the solid film of water-soluble polymer 106 to the water-impermeable sheet material layer 96 or to the adhesive composition 12.

EXAMPLE

A mixture of 75% by weight sodium bentonite clay, 20% by weight partially cross-linked butyl rubber and 5% by weight polybutene was thoroughly mixed and the rubber masticated to provide a tacky, adhesive waterproofing composition layer 60 mils tick. A 30 mil thick layer of medium density polyethylene was applied to a major surface of an extruded layer of the waterproofing composition, and a 1.5 mil thick film of polyvinyl alcohol was applied to an opposite major surface of the extruded layer of waterproofing composition, as shown in FIG. 3. The three-layer article was rolled, as shown in FIG. 2, without the article adhering to itself. After wetting a concrete slab surface with water, the article was pressure applied, as shown in FIG. 4, applying the polyvinyl alcohol-coated major surface of the article against the wetted concrete surface to the substantial exclusion of oxygen between the article and the concrete surface. Twenty-four hours later, the article was tenaciously adhered to the concrete upper surface. Separating the article from the concrete surface revealed strings of polyvinyl alcohol film tenaciously held and stretched between the bentonite clay-containing adhesive layer and the surface of the concrete, acting as an adhesive.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

What is claimed is:

1. A composite material comprising a concrete substrate;

a water-soluble polymer film in a thickness of at least 1 mil and secured to the concrete substrate;

a layer of an adhesive composition secured to the water-soluble polymer layer, said adhesive composition containing a water-swellable bentonite clay in an amount of 35–90% by weight, an elastomer in an amount of 1–20% by weight, and a plasticizer in an amount of 2–50% by weight, based on the total weight of the adhesive composition; and a flexible water-impermeable sheet material secured to the layer of adhesive composition.

2. The composite material of claim 1, wherein the film of water-soluble polymer is secured to the adhesive composition essentially continuously, and coextensive with the sheet material, and wherein said film of water-soluble polymer has a thickness of at least 1.5 mils.

3. The composite material of claim 1, wherein the film of water-soluble polymer is discontinuously coated over the adhesive composition layer.

4. The composite material of claim 1, wherein the water-soluble polymer comprises polyvinyl alcohol.

5. The composite material of claim 1, wherein the water-impermeable sheet material is selected from the group consisting of polyethylene, polypropylene, polyvinyl chloride, and water-impermeable copolymers including an ethylene, propylene, or vinyl chloride.

6. The composite material of claim 5, wherein the water-soluble polymer has a thickness in the range of about 1.5 mils to about 15 mils.

7. The composite material of claim 1, wherein the water-soluble polymer is selected from the group consisting of: poly(vinyl alcohol); poly(vinyl acetate); copolymers of vinyl alcohol and vinyl acetate; polyvinylpyrrolidone; poly-(acrylic acid) and its metal salts; and combinations thereof.

8. The composite material of claim 1, wherein the adhesive composition includes water-swellable sodium bentonite clay in an amount in the range of about 35% to about 90% based on the weight of the adhesive composition, capable of expanding on water contact to prevent water penetration to the concrete substrate.

* * * * *

UNITED STATES PATENT AND TRADEMARK OFFICE

CERTIFICATE OF CORRECTION

PATENT NO. : 5,580,630

DATED : DECEMBER 3, 1996

INVENTOR : STACY W. BYRD

It is certified that error appears in the above-identified patent and that said Letters Patent is hereby corrected as shown below:

At column 14, line 25, after "polymer" insert -- film --.

Signed and Sealed this

Twenty-second Day of July, 1997

Bruce Lehman

*Attest:*

BRUCE LEHMAN

*Attesting Officer*

*Commissioner of Patents and Trademarks*